United States Patent [19]

Blain

[11] Patent Number: 4,600,369

[45] Date of Patent: Jul. 15, 1986

[54] POSITIVE DISPLACEMENT SCROLL TYPE APPARATUS WITH FLUID PRESSURE BIASING THE SCROLL

[75] Inventor: Edward S. Blain, Rockford, Ill.

[73] Assignee: Sundstrand Corporation, Rockford, Ill.

[21] Appl. No.: 774,708

[22] Filed: Sep. 11, 1985

[51] Int. Cl.[4] ..... F01C 1/04; F01C 19/00

[52] U.S. Cl. ..... 418/55; 418/57

[58] Field of Search ..... 418/55, 57

[56] References Cited

U.S. PATENT DOCUMENTS

| | | | |
|---|---|---|---|
| 3,600,114 | 8/1971 | Dvorak et al. | 418/57 |
| 3,884,599 | 5/1975 | Young et al. | 418/57 |
| 3,994,633 | 11/1976 | Shaffer | 418/55 |
| 4,178,143 | 12/1979 | Thelen et al. | 418/57 |
| 4,357,132 | 11/1982 | Kousokabe | 418/55 |
| 4,475,874 | 10/1984 | Sato | 418/55 |

*Primary Examiner*—John J. Vrablik

*Attorney, Agent, or Firm*—Wood, Dalton, Phillips, Mason, & Rowe

[57] ABSTRACT

Skating movement of seals in a positive displacement scroll apparatus having two scrolls which rotate with each other and additionally undergo relative orbiting movement, is avoided in a pressure balancing cavity construction by providing a chamber defining element which is coupled by bolts to the scroll. The seals thus rotate with the scrolls and move only across their short dimension as the scrolls undergo relative orbiting movement.

9 Claims, 1 Drawing Figure

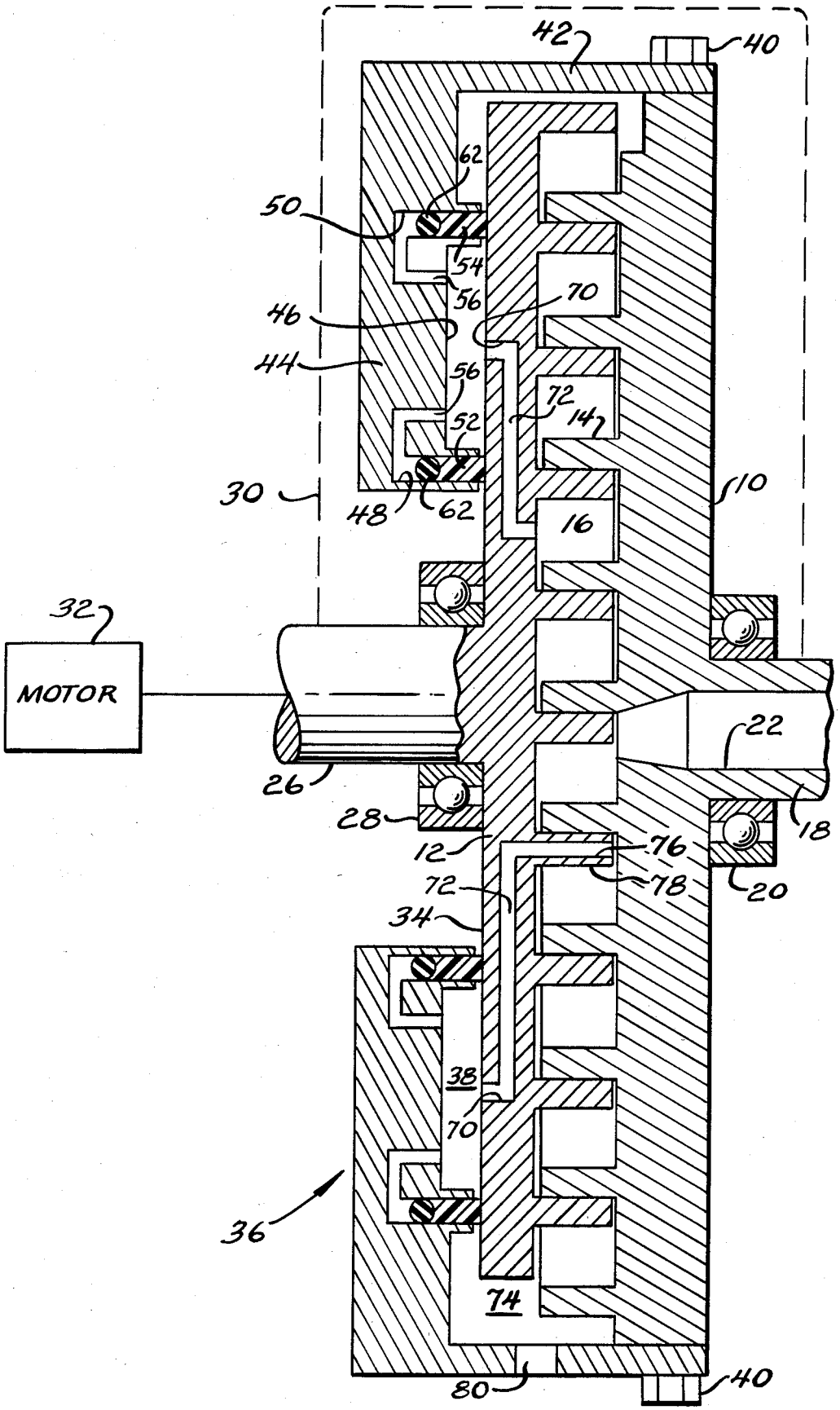
42
40
62
50
54
56
70
46
44
56
72
14
52
30
48
62
10
16
32
MOTOR
22
26
28
18
12
76
78
20
72
34
38
70
36
74
80
40

POSITIVE DISPLACEMENT SCROLL TYPE APPARATUS WITH FLUID PRESSURE BIASING THE SCROLL

FIELD OF THE INVENTION

This invention relates to positive displacement, scroll type apparatus which may be used as a pump, compressor, expander or the like.

BACKGROUND OF THE INVENTION

Positive displacement apparatus of the scroll type have generated substantial interest for a number of reasons. For one, they are relatively simple. For another, their physical size may be relative small as compared to other types of positive displacement apparatus having the same capacity.

Their use, however, is not without attendant difficulties. As is well known, such apparatus constitutes two facing scroll plates each having spiral type vanes which interfit to define a plurality of closed pockets. When one of the scrolls is orbited relative to the other, the pockets travel between radially inner and outer ports to convey the working fluid.

Because there will always be a zone of high pressure at the interface between the scrolls during operation, such pressure tends to axially move the scrolls apart and such moving tends to interfere with proper sealing of the pockets both on the flanks and on the tips of the vanes. And, as sealing efficiency is lost, the efficiency of the apparatus likewise suffers.

To overcome this difficulty, the prior art has proposed that the scrolls be axially preloaded towards each other. The preload is sufficient to resist the separating force applied to the scrolls during the operation of the apparatus. However when the apparatus is quiescent, the preload results in relatively high frictional forces existing between the scrolls and/or bearings supporting the same. As a consequence, the initiation of operation of the apparatus becomes much more difficult.

To avoid this problem, the prior art has proposed the application of a pressurized fluid to one or both of the scrolls opposite the interface. Thus, a force resisting the separating force is generated and through known techniques, the two forces may be made to balance. U S. Pat. No. 4,384,831 issued May 24, 1983 to Ikegawa is representative of this approach. It will be observed that this approach is applied in the context of a scroll apparatus of the type wherein one scroll is stationary and the other is orbited with respect thereto. As is well known in the art, there is another common sort of scroll apparatus, namely, one wherein both scrolls rotate simultaneously while one of the scrolls is orbited with respect to the other at the same time. The approach applied by Ikegawa has not been applied to scroll apparatus of the latter type because of the problems of sealing a stationary chamber located opposite the interface of the scroll with a rotating or a rotating and orbiting scroll. In particular, though the seals would be curved, they would be moving across the relatively moving surface between the chamber and the scroll generally along their long dimension, much like an ice skate moving across ice. The skating action is subject to lubrication difficulties and accelerated wear with the result that the pressure balancing approach mentioned previously is not known to have been applied to scroll type apparatus of the type wherein both scrolls rotate with one scroll additionally orbiting with respect to the other.

The present invention is directed to overcoming this problem.

SUMMARY OF THE INVENTION

It is the principal object of the invention to provide a new and improved positive displacement scroll type apparatus. More specifically, it is an object of the invention to provide a positive displacement scroll type apparatus of the type wherein both scrolls rotate and one scroll additionally orbits with respect to the other and having a pressure balancing chamber disposed to act against one scroll oppositely of the interface of the scrolls.

An exemplary embodiment of the invention achieves the foregoing objects in a structure including first and second scrolls having an interface including interfitting vanes adapted to define movable pockets that travel along the interface. Radially spaced ports are located in the scrolls and extend to the interface. Means are provided for journaling both of the scrolls for rotation and linking the scrolls for relative orbiting movement. Means are also provided for rotating the scrolls and causing the relative orbiting movement so that the pockets travel between the ports. One of the scrolls is provided with a pressure responsive surface oppositely of the interface between the scrolls and a chamber defining element is carried by the other of the scrolls and together with the surface defines a generally sealed cavity oppositely of the interface between the scrolls. An inlet is provided to the cavity for receipt of a fluid under elevated pressure to act against the surface on the one scroll in opposition to pressurized fluid at the interface.

According to a preferred embodiment of the invention, the chamber defining element comprises a sleeve mounted on the other scroll to extend axially about the one scroll. The sleeve has a radially inwardly directed web which is aligned with the pressure responsive surface on the one scroll and an annular recess is located in the side of the web facing the surface so as to define the cavity along with the surface.

The invention contemplates that there be radially inwardly and outwardly located annular grooves on such side of the web in surrounding relation to the annular recess along with seals in the grooves which are in sealing engagement with the pressure responsive surface.

Preferably, passages extend from the recess to the grooves oppositely of the surface to provide pressurizing fluid to the seals.

The invention further contemplates the provision of a conduit within the one scroll extending from the inlet to a port on the interface between the scrolls at an elevated pressure zone thereat. Thus, high pressure fluid from the interface is utilized to pressurize the cavity.

Other objects and advantages will become apparent from the following specification taken in connection with the accompanying drawings.

DESCRIPTION OF THE DRAWINGS

The figure is a sectional view of a positive displacement scroll type apparatus made according to the invention with certain components shown somewhat schematically.

DESCRIPTION OF THE PREFERRED EMBODIMENT

An exemplary embodiment of a positive displacement scroll type apparatus made according to the invention is illustrated in the drawing and with reference thereto is seen to include first and second scroll plates 10 and 12 respectively. At their interface, the scroll plates 10 and 12 respectively have one or more generally spiraled, interfitting vanes 14 and 16 which, as is well known, ultimately define sealed pockets for containing the working fluid. The configuration of the vanes 14 and 16 is well known and forms no part of the present invention.

The scroll plate 10 is mounted on a shaft 18 journaled by bearings 20. The shaft 18 has a central bore 22 extending to the interface of the scroll plates 10 and 12. The bore 22 serves as a port to or from the interface and will serve as an outlet port when the apparatus is used as a compressor or a pump.

Radially outwardly spaced from the port 22, and at the periphery of the interface is a further port shown generally at 24, which, when the apparatus is used as a pump or a compressor, acts as an inlet port.

The scroll plate 12 is likewise mounted on a shaft 26 which in turn is journaled by bearings 28. Any one of a variety of known forms of linkages, shown schematically at 30, may be employed to link the shafts 18 and 26 (or the scroll plates 10 and 12) so that scroll plates 10 and 12 may rotate simultaneously within their respective bearings 20 and 28 and one of the scroll plates 10 and 12 may orbit with respect to the other. Linkages of the sort employed at 30 are well known and form no part of the present invention.

To rotate the components and to cause relative orbiting movement, a motor 32 coupled to the shaft 26 may be provided.

The scroll plate 12 has a surface 34 on its side opposite from the interface between the scroll plates 10 and 12 and a portion of this surface, together with a chamber defining element, generally designated 36, defines an annular, sealed cavity 38. The chamber defining element 36 is carried by, that is, coupled to, the scroll plate 10 for movement therewith. This is achieved through the use of bolts 40 threaded into bores (not shown) in the scroll plate 10 to secure a generally cylindrical sleeve 42 to the scroll plate 10. The sleeve 42 is of somewhat larger diameter than the scroll plate 28 and extends axially about the same. The sleeve 42 supports a radially inwardly directed, annular web 44 which is aligned generally with the pressure responsive surface 34 on the scroll plate 12. The side of the web 44 facing the surface 34 includes an annular, axially opening recess 46 which, in turn, defines the other boundary of the cavity 38. Both radially inwardly and radially outwardly of the recess 46, the web 44 has axially opening, annular, seal receiving grooves 48 and 50 for receipt of annular seal rings 52 and 54 respectively. The seal rings 52 and 54 are gas energized into sealing engagement with the surface 34 by means of passages 56 extending from the cavity 38 to the grooves 48 and 50. Thus, pressurized gas within the cavity 38 will act to drive the seals 52 and 54 out of the respective grooves 48 and 50 and into good sealing engagement with the surface 34. To prevent any substantial leakage around the seals 52 and 54 themselves, the seals 52 and 54 may be backed by O-rings 62 which seal against the sides of the grooves 48 and 50.

To deliver a relatively high pressure fluid to the cavity 38, the same is provided with an inlet 70 located in the surface 34 of the scroll plate 12. A conduit 72 within the scroll plate 12 extends from the inlet 70 to the interface between the scroll plates 10 and 12 at a high pressure zone at such interface. When the apparatus is used as a pump or compressor, such a zone will be located along the axes of the shafts 18 and 26.

Thus, the high pressure tending to separate the scroll plates 10 and 12 during operation, will be conveyed to the interior of the cavity 38 and will act against the surface 34 to balance the separating force.

In some instances, it may be desirable that the conduit 72 opened to the interface between scroll plates 10 and 12 at an opening 76 in the tip 78 of the vane 16.

If the sleeve 42 is solid as illustrated in the drawing, one or more openings 80 may be disposed therein to provide an inlet to the inlet port 24 at the interface between the scroll plates 10 and 12.

In considering operation of the device, it will be appreciated that the chamber defining element 38 rotates with the scroll plate 10 which in turn rotates with the scroll plate 12, although the two do undergo relative orbiting movement. As a consequence of this construction, movement of the seals 52 and 54 against the surface 34 will be generally across the short dimension of the seals (i.e. their width) rather than their length. Thus, skating movement of the seals is avoided, greatly enhancing the life of the seals 52 and 54. Thus, a pressure balancing system employing the cavity 38 with long life seals is provided for a scroll type apparatus of the sort wherein both scrolls rotate and additionally undergo relative orbiting movement.

I claim:

1. Positive displacement scroll type apparatus comprising:

first and second scrolls having an interface including interfitting spiral vanes adapted to define movable pockets that travel along said interface;

radially spaced ports in said scrolls extending to said interface;

means journalling both of said scrolls for rotation and linking said scrolls for relative orbiting movement;

means for rotating said scrolls and causing said relative orbiting movement so that said pockets travel between said ports;

one of said scrolls having a pressure responsive surface oppositely of said interface;

a chamber defining element carried by the other of said scrolls and together with said surface defining a generally sealed cavity oppositely of said interface; and an inlet to said cavity for receipt of a fluid under elevated pressure to act against said surface in opposition to pressurized fluid at said interface.

2. The positive displacement scroll type apparatus of claim 1 wherein said element comprises a sleeve mounted on said other scroll to extend axially about the said one scroll, a radially inwardly directed web on said sleeve and aligned with said surface, and an annular recess in the side of said web facing said surface.

3. The positive displacement scroll type apparatus of claim 2 wherein there are radially inwardly and outwardly located annular grooves on said side in surrounding relation to said annular recess, and seals in said grooves in sealing engagement with said surface.

4. The positive displacement scroll type apparatus of claim 3 further including passages extending from said recess to said grooves oppositely of said surface to provide pressurizing fluid to said seals.

5. The positive displacement scroll type apparatus of claim 1 further including a conduit within said one scroll extending from said inlet to a port on said interface at an elevated pressure zone thereof.

6. The positive displacement scroll type apparatus of claim 5 wherein said port on said interface is disposed on the tip of the vane on said scroll.

7. Positive displacement scroll type apparatus comprising:

first and second scrolls having an interface including interfitting spiral vanes adapted to define movable pockets that travel along said interface;

radially spaced ports in said scrolls extending to said interface;

means journalling both of said scrolls for rotation and linking said scrolls for relative orbiting movement;

means for rotating said scrolls and causing said relative orbiting movement so that said pockets travel between said ports;

one of said scrolls having a pressure responsive surface oppositely of said interface;

a chamber defining element which together with said surface defines a generally sealed cavity oppositely of said interface;

an inlet to said cavity for receipt of a fluid under elevated pressure to act against said surface in opposition to pressurized fluid at said interface; and means coupling said element to said other scroll for movement therewith.

8. The positive displacement scroll type apparatus of claim 7 wherein said inlet is in said one scroll and in fluid communication with said interface.

9. The positive displacement scroll type apparatus of claim 8 wherein said element is plate-like having an annular recess opening toward said surface and said coupling means is a structure extending axially from said other scroll about said one scroll to mount said element.

* * * * *